United States Patent [19]

Comora

[11] Patent Number: 4,925,064

[45] Date of Patent: May 15, 1990

[54] BACKPACK CUSHIONING DEVICE

[76] Inventor: Michael E. Comora, 7424 E. Speedway Blvd., Tuscon, Ariz. 85710

[21] Appl. No.: 193,088

[22] Filed: May 12, 1988

Related U.S. Application Data

[63] Continuation-in-part of Ser. No. 64,008, Jun. 19, 1987, abandoned.

[51] Int. Cl.[5] ..... A45F 3/26

[52] U.S. Cl. ..... 224/155; 224/209; 224/907; 297/4

[58] Field of Search ..... 224/155, 156, 101, 212, 224/210, 209, 907, 901; 5/417, 419, 420; 297/4, DIG. 6

[56] References Cited

U.S. PATENT DOCUMENTS

| | | | |
|---|---|---|---|
| 33,385 | 10/1861 | Frodsham | 224/156 |
| 1,723,831 | 8/1929 | Weymouth | 297/4 |
| 3,143,748 | 8/1964 | Manning | 5/420 |
| 3,284,819 | 11/1966 | Nissen | 5/420 |
| 4,089,447 | 5/1978 | Achmeteli | 224/214 |
| 4,530,451 | 7/1985 | Hamilton | 224/155 |
| 4,588,224 | 5/1986 | Hill, Jr. | 297/4 |

FOREIGN PATENT DOCUMENTS

| | | | |
|---|---|---|---|
| 122811 | 5/1931 | Austria | 224/156 |
| 43836 | 3/1931 | Denmark | 224/212 |

*Primary Examiner*—Renee S. Luebke

*Attorney, Agent, or Firm*—Mathews, Woodbridge, & Collins

[57] ABSTRACT

A cushioning device which is quickly and easily attachable/detachable to backpacks of various sizes to, thusly, substantially reduce discomfort and abrasion from objects within a backpack which otherwise would rub against the back of the user of the backpack. The device is also functional as an upper and lower body cushion for use upon the ground, chairs and the like.

7 Claims, 1 Drawing Sheet

FIG. 1
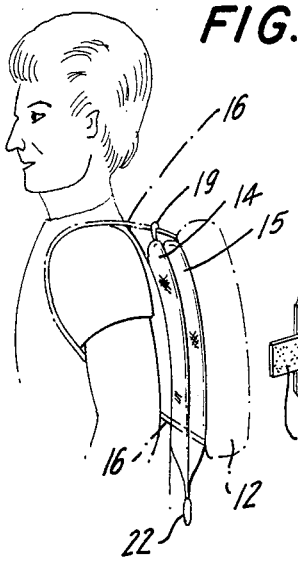
FIG. 3
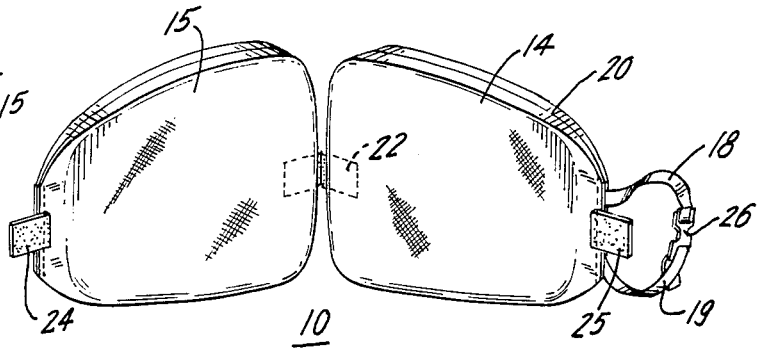
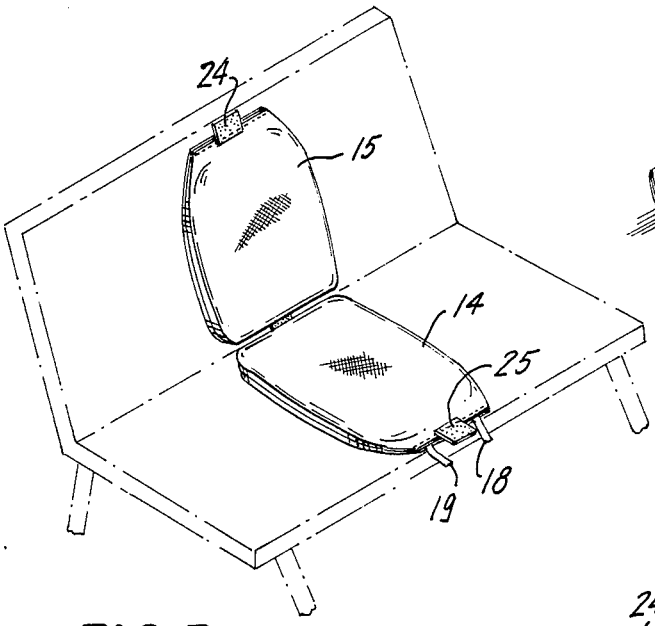
FIG. 5
FIG. 4
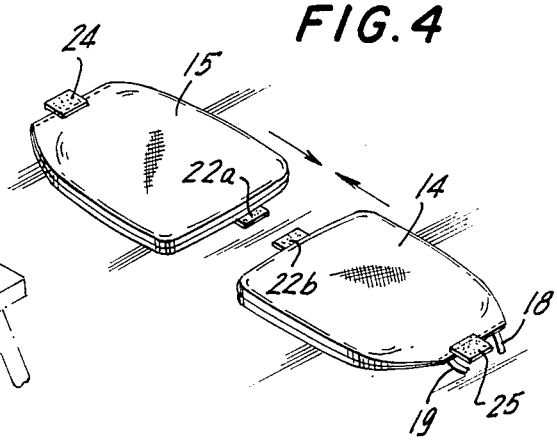
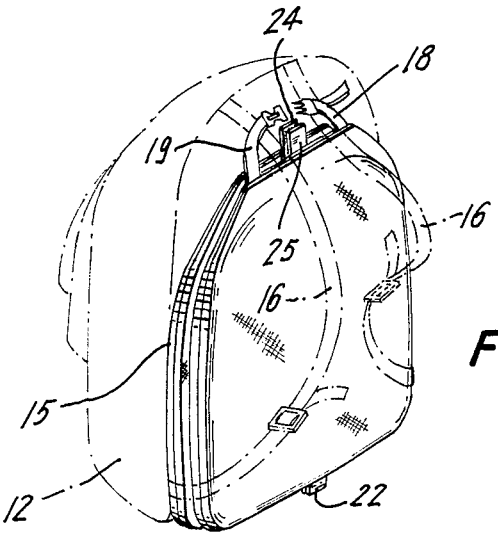
FIG. 2

BACKPACK CUSHIONING DEVICE

REFERENCE TO RELATED APPLICATION

This case is a Continuation-in-Part of Application Ser. No. 07/064,008, filed June 19, 1987, entitled Backpack Cushioning Device, now abandoned.

BACKGROUND OF THE INVENTION

The present invention relates to a cushioning device adapted for use with various types of backpacks and, more particularly, designed for quick and easy attachment and removal of the cushioning device from the back of the user.

A long-standing problem in the use of various backpacks, particularly with so-called frameless backpacks, is that objects within the backpack are apt to rub against the back of the user thereby causing abrasion and generalized discomfort.

Some backpack manufacturers have responded to this problem by the building of padding directly into the backpack proper. Such an example of this appears in U.S. Pat. No. 4,420,103 (1983) to Douglass, entitled Backpack. In Douglass there is shown padding material incorporated into the generalized structure of the backpack.

Another approach to the above problem has been to employ a pre-molded, semi-rigid resilient surface for that side of the backpack with which the back of the user will make contact. An example of this approach appears in U.S. Pat. No. 3,902,640 (1975) to Geigen, entitled Hiker's Backpack.

Another approach seen in the prior art is that of simply attaching padding to the belt of the user to be employed by the user in the manner desired by him. Such an approach appears in U.S. Pat. Nos. 3,185,362 (1965) to Wakefield, entitled Combination Seat-Pack; and No. 4,588,224 (1986) to Hill, entitled Belt-Attached Seat.

U.S. Pat. No. 4,190,918 (1980) to Harrel teaches a combination of folding cushion and carrying assembly which, however, is not adapted for use with backpacks. Accordingly, none of the above-referenced prior art or other art known to the inventor teaches the use of a cushioning device which is quickly and easily attachable and detachable from a wide variety of backpacks and which, as well, is capable of an important secondary function of use as a cushion or pad, apart from its use in connection with backpacking. It is toward this object that the present invention is directed.

SUMMARY OF THE INVENTION

The instant invention comprises a two-panel cushioning device for use with a backpack, said panels are proportioned and hinged to fold upon each other to thereby form a substantially common periphery, said common periphery is generally proportioned to the size of a backpack, said panels are provided with transversely secured loop means for holding said panels, when mutually folded upon each other, upon the shoulder straps of the backpack to thereby position the cushioning device in a manner relative to the back of the user that will afford to the user a maximum degree of comfort.

When the cushioning device is not employed in its backpack cushioning function, the panels thereof may be unfolded and such panels may be employed as an upper and lower body cushion which may be placed on the ground, chairs, benches or the like, as a resting means for the user.

It is accordingly an object of the present invention to provide a cushioning device for use with backpacks to cushion the back of the user across the entire length and width of the backpack.

It is a further object to provide a device of the above type which may be used as an upper and lower body rest cushion.

It is a further object of the invention to provide a cushioning device for backpacks which is easily attachable and detachable from the backpack proper and, which, when not in such use, may be employed to serve a variety of padding functions such as sitting, kneeling, and the resting of one's head.

The above and yet other objects and advantages of the present invention will become apparent from the hereinafter set forth Detailed Description of the Invention, Drawings, and Claims appended herewith.

BRIEF DESCRIPTION OF THE DRAWINGS

FIG. 1 is a side perspective schematic view of the inventive cushioning device used in combination with a backpack.

FIG. 2 is an enlarged perspective view showing the mating relationship between the cushioning device and the relationship of the straps of the backpack to the straps of the device.

FIG. 3 is a perspective schematic view showing the inventive cushioning device in a semi-unfolded position.

FIG. 4 is a perspective view showing the panels of the cushioning device separated from each other.

FIG. 5 is a perspective view showing the use of the unfolded cushioning device for the purpose of providing cushioning to a bench.

DETAILED DESCRIPTION OF THE INVENTION

With reference to the view of FIG. 1, there may be seen the inventive cushioning device 10 and the manner in which it is positioned between a backpack 12 and the back of a user. As may be noted, cushioning device 10 is proportioned to conform to both the length and the width of backpack 12, thereby affording complete protection to the back of the user.

As may be seen from the views of FIGS. 1 and 2, backpack 12 is affixed to the back of the user through the use of straps 16, while cushioning device 10 is held to the backpack by straps 18 and 19, more fully described below.

Said cushioning device 10 comprises two panels 14 and 15 which are held together by hinge means 22 depending from opposing transverse edges of such panels that hinge means 22 may define a single integral element or, in the alternative, may be defined by two VELCRO-like elements **22*a* and 22*b* in mating relationship thereto. See FIGS. 3 and 4**.

Said panels 14 and 15 may be formed of any foam-like resilient material and covered by any durable fabric. Seams 20 are shown in FIG. 3 to indicate that, in the preferred embodiment, an appropriately durable fabric will simply be sewn about the resilient foam-like material of panels 14 and 15.

Said panels are further provided with straps 18 and 19 which, in the view of FIG. 3 are, at one end of each, sewn into seam 20.

Shown in FIGS. 3 and 4 are locking elements 24 and 25, which elements are preferably of a VELCRO-like material such that said panels 14 and 15 may be securably held to each other as the cushioning device is employed in the manner shown in FIGS. 1 and 2, said locking elements depend from non-opposing transverse edge of said panels.

In FIGS. 1 to 3, it is to be further noted that straps 18 and 19 of the cushioning device are placed over straps 16 of backpack 12. The desired elevation of the cushioning device 10 relative to backpack 12 is obtained through the use of length adjustment means 26 provided at the ends of straps 18 and 19.

As may be appreciated from the views of FIGS. 1 and 2, two thick pads of resilient foam provide protection to the back of the user.

After the user has completed his hiking, or is desirous of taking a rest, adjustment means 26 may be readily released after the hiker has removed straps 16 from his shoulders. Thereupon, the present inventive cushioning device may be employed as shown in FIG. 5, which is that of an upper and lower body cushion which, in addition to use on benches, may as well be used as a padding for chairs and on the ground.

Accordingly, while there have been shown and described the preferred embodiment of the present invention, it will be understood that the invention may be embodied otherwise than we herein specifically illustrated or described and that, within said embodiment, certain changes in the detail and construction, and the form of arrangement of the parts, may be made without departing from the underlying idea or principles of this invention within the scope of the appended claims.

Having thus described my invention, what I claim as new, useful, and non-obvious and, accordingly, secure by Letters Patent of the United States is:

1. A cushioning device in combination with a backpack;

the backpack comprising:

a pack, having a back surface; and shoulder straps, connected to the pack;

the cushioning device comprising:

a first panel;

a second panel, the first panel and second panel each having an opposing edge, and non-opposing edges;

a hinge means connecting the opposing edges of the first panel and the second panel, the first panel and second panel capable of being separated at the hinge means;

locking elements connected to the first panel and the second panel to lock the panels against each other;

straps attached to at least one of the panels to secure the locked panels to the shoulder straps of the backpack with the panels adjacent to the back surface of the backpack.

2. The device of claim 1 wherein the locking elements are connected to the non-opposing edges of the first panel and the second panel.

3. The device of claim 1 wherein the locking elements are a hook and loop fastening means.

4. The device of claim 1 wherein the hinge means is a hook and loop fastening means.

5. The device of claim 1 wherein th elength and width of the first panel and second panel correspond to the length and width of the back surface of the backpack.

6. The device of claim 1 wherein the straps are attached to at least one non-opposing edge of one of the panels.

7. The device of claim 6 wherein the straps comprise two straps, with each strap having means to adjust the length thereof.

* * * * *